US010324389B2

(12) United States Patent
Sakamoto et al.

(10) Patent No.: US 10,324,389 B2
(45) Date of Patent: Jun. 18, 2019

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Shinya Sakamoto, Kanagawa (JP); Tsuyoshi Murakami, Kanagawa (JP); Tomoaki Tanaka, Kanagawa (JP); Masaki Iwase, Kanagawa (JP); Ryutaro Kembo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/953,505

(22) Filed: Apr. 16, 2018

(65) Prior Publication Data

US 2019/0094729 A1 Mar. 28, 2019

(30) Foreign Application Priority Data

Sep. 26, 2017 (JP) ..... 2017-185233

(51) Int. Cl.

| | |
|---|---|
| ***G03G 9/09*** | (2006.01) |
| ***G03G 9/08*** | (2006.01) |
| ***G03G 9/087*** | (2006.01) |

(52) U.S. Cl.

CPC ..... *G03G 9/0825* (2013.01); *G03G 9/0819* (2013.01); *G03G 9/0827* (2013.01); *G03G 9/08755* (2013.01); *G03G 9/0902* (2013.01)

(58) Field of Classification Search

CPC ..... G03G 9/0902; G03G 9/0926; G03G 9/09342; G03G 9/09708

See application file for complete search history.

(56) References Cited

U.S. PATENT DOCUMENTS

| | | | | |
|---|---|---|---|---|
| 3,957,526 | A * | 5/1976 | Hodgkin | C09C 1/3692 106/445 |
| 4,943,506 | A * | 7/1990 | Demizu | G03G 9/0902 430/108.3 |
| 5,993,533 | A * | 11/1999 | Diebold | C09C 1/3653 106/442 |
| 7,264,672 | B1 * | 9/2007 | Trabzuni | C09C 1/3661 106/436 |
| 8,298,737 | B2 | 10/2012 | Kadokura et al. | |
| 2011/0052882 | A1 * | 3/2011 | Gong | G03G 9/0812 428/195.1 |
| 2013/0330522 | A1 * | 12/2013 | Suzuki | G03G 9/0902 428/195.1 |

FOREIGN PATENT DOCUMENTS

| | | |
|---|---|---|
| JP | 2003255606 | 9/2003 |
| JP | 2010008816 | 1/2010 |
| JP | 2011150257 | 8/2011 |
| JP | 2011154183 | 8/2011 |

* cited by examiner

*Primary Examiner* — Peter L Vajda
(74) *Attorney, Agent, or Firm* — JCIPRNET

(57) ABSTRACT

An electrostatic charge developing toner includes a toner particle that includes a pigment particle having a surface aluminum proportion by an X-ray photoelectron spectroscopy of 6.0 atom % or more and 12.0 atom % or less and a binder resin having a carboxy group.

12 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2017-185233 filed Sep. 26, 2017.

BACKGROUND

(i) Technical Field

The present invention relates to an electrostatic charge image developing toner, an electrostatic charge image developer, and a toner cartridge.

(ii) Related Art

In electrophotographic image formation, an electrostatic charge image developing toner (hereinafter also simply referred to as a "toner") is used as an image forming material, and, for example, a toner particle including a binder resin and a colorant, and an external additive externally added to the toner particle are widely used.

Further, in the related art, a technique of using a toner having a toner particle including a white pigment in the image formation by the electrophotographic method is known.

SUMMARY

According to an aspect of the invention, there is provided an electrostatic charge developing toner including: a toner particle that includes a pigment particle having a surface aluminum proportion by an X-ray photoelectron spectroscopy of 6.0 atom % or more and 12.0 atom % or less and a binder resin having a carboxy group.

BRIEF DESCRIPTION OF THE DRAWINGS

Exemplary embodiment(s) of the present invention will be described in detail based on the following figures, wherein.

DETAILED DESCRIPTION

Figure 1:
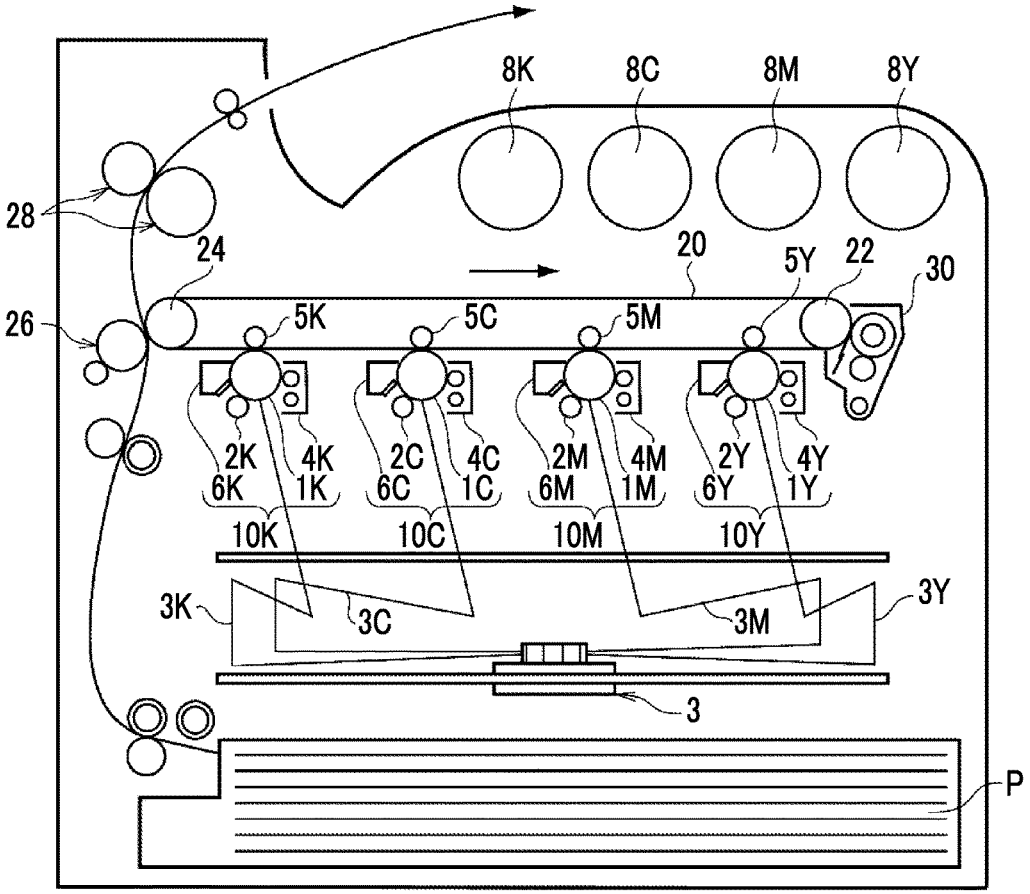
FIG. 1 is a schematic view illustrating a configuration of an image forming device according to this exemplary embodiment.

Hereinafter, an exemplary embodiment which is an example of the invention is described in detail.

The expressions "parts by mass" and "mass %" are the same as "parts by weight" and "weight %".

Electrostatic Charge Image Developing Toner

The electrostatic charge image developing toner according to this exemplary embodiment includes a toner particle including a pigment particle having a surface aluminum proportion by an X-ray photoelectron spectroscopy of 6.0 atom % or more and 12.0 atom % or less and a binder resin having a carboxy group.

A pigment particle used at kneading in paints and plastics is subjected to surface coating with alumina for the purpose of suppressing deterioration of a resin contained in paints and plastics due to the catalytic action of pigment particle surface.

In the toner, in a case where a surface-coated pigment particle is used as a colorant, the toner in a low charge amount may be generated in a case of continuous printing (for example, in a case of continuous printing of 10,000 sheets).

In the toner according to this exemplary embodiment, the surface aluminum proportion by the X-ray photoelectron spectroscopy in the pigment particle is 6.0 atom % or more and 12.0 atom % or less, the generation of the toner having a low charge amount in a case of continuous printing is suppressed.

The mechanism for obtaining the effect is not clear, but it is assumed as follows.

In a case where the surface aluminum proportion is less than 6.0 atom %, it is considered that the interaction between the aluminum compound included in the surface and the binder resin included in the toner particle decreases, and thus the adhesiveness decreases, so that the pigment particle easily drops out from the toner. In a case where the surface aluminum proportion is low, it is also considered that the binder resin is modified due to the catalytic effect on the pigment particle surface, and the pigment particle easily drops off from the toner.

Since the pigment particle has charge exchange abilities, it is considered that the toner from which a pigment particle has dropped becomes a toner having a low charge amount.

In a case where the surface aluminum proportion is more than 12.0 atom %, it is considered that the dropping off of the pigment particle is suppressed, but the content of the nonconductive aluminum compound (for example, aluminum oxide) on the surface of the pigment particle increases, so that the charge exchange abilities of the pigment particle decrease and the toner having a low charge amount is generated.

In a case where the binder resin does not have a carboxy group, it is considered that the interaction between the pigment particle and the binder resin decreases, the pigment particle easily drops off from the toner, and thus the toner having a low charge amount is generated.

In the toner according to this exemplary embodiment, in a case where generation of such a toner having a low charge amount is suppressed, and particularly in a case where a low density image is formed in a low temperature and low humidity environment and a high density image is formed in a high temperature and high humidity environment, it is considered that the generation of the image defect (for example, the generation of white spots) is easily suppressed.

In a case where a low density image is formed in a low temperature and low humidity environment, in a case where a toner consumption amount decreases, and the same toner is continuously stirred in the developing machine, such that the surface of the toner particle is easily worn and the dropping of the pigment particle easily generated. Further, in a high temperature and high humidity environment, it is considered that the difference of the charge amounts between the toner from which the pigment particle is dropped off and the toner from which the pigment particle is not dropped off easily becomes great. For this reason, in a case where a low density image in a low temperature and low humidity environment is formed, and a high density image in a high temperature and high humidity environment is formed, particularly, it is considered that a toner having a low charge amount is easily generated, and as a result, an image defect is generated.

Hereinafter, details of the electrostatic charge image developing toner according to this exemplary embodiment are described.

Pigment Particle

The electrostatic charge image developing toner according to this exemplary embodiment includes a pigment particle having a surface aluminum proportion by the X-ray photoelectron spectroscopy of 6.0 atom % or more and 12.0 atom % or less.

For example, preferably the pigment particle is a white pigment particle.

Aluminum Compound

For example, preferably the pigment particle includes an aluminum compound on the surface and includes aluminum oxide. The aluminum oxide is not particularly limited, and preferably examples thereof include alumina ($Al_2O_3$).

For example, preferably the electrostatic charge image developing toner according to this exemplary embodiment includes aluminum hydroxide ($Al(OH)_3$) on the surface.

In the toner according to this exemplary embodiment, in the toner particle, according to the interaction between the aluminum oxide and the carboxy group included in the binder resin or the interaction between the aluminum hydroxide of the carboxy group included in the binder resin, it is considered that the dropping of the pigment particle from the toner particle is suppressed.

Surface Aluminum Proportion

In the pigment particle according to this exemplary embodiment, the surface aluminum proportion by the X-ray photoelectron spectroscopy is 6.0 atom % or more and 12.0 atom % or less.

In view of suppressing the generation of the toner having a low charge amount, for example, the surface aluminum proportion is preferably 8.0 atom % or more and 10.0 atom % or less.

The surface aluminum proportion is measured by the X-ray photoelectron spectroscopy (XPS).

Specifically, the measurement is performed by dissolving the toner in tetrahydrofuran, acetone, methyl ethyl ketone, toluene or the like, collecting the pigment particles, performing the XPS measurement by the following conditions, and calculating the proportion of the peak surface area value of the peak derived from aluminum in the obtained data to the peak surface area value of all the measured peaks.

XPS Measurement Condition

X-ray photoelectron spectrometer: JPS-9000 MX manufactured by JEOL Ltd.

X-ray source: MgKα ray

Acceleration voltage: 10.0 kV

Emission current: 20 mA

Path energy of photoelectron energy analyzer: 30 V

The surface atomic concentration is calculated by using a relative photosensitivity factor manufactured by JASCO Corporation, and the background correction and the area are calculated according to analytical application software manufactured by JEOL Ltd.

Aluminum Proportion with Respect to Entire Pigment Particle

In view of whiteness of the pigment, with respect to the pigment particle, the content of aluminum in the entire pigment particle is, for example, preferably more than 0 mass % and 2.0 mass % or less and more preferably 0.5 mass % or more and 1.5 mass % or less.

The content of aluminum which is present in the entire pigment particle is measured by the X-ray fluorescence analysis (XRF) method.

Specifically, the content of aluminum in the entire pigment particle is measured as a peak surface area value of a peak derived from aluminum with respect to the peak surface area value derived from the entire elements in the pigment particles, by setting the measurement conditions to a tube voltage of 40 KV, a tube current of 90 mA, and measurement time of 30 minutes.

Other Components in Pigment Particle

The pigment particle used in this exemplary embodiment is, for example, preferably includes titanium oxide, zinc oxide, or zirconium oxide, more preferably includes titanium oxide, and even more preferably includes titanium dioxide.

The pigment particle used in this exemplary embodiment is, for example, preferably a titanium oxide particle in which an aluminum compound (preferably aluminum oxide) is adhered to the surface, a zinc oxide particle in which an aluminum compound (preferably aluminum oxide) is adhered to the surface, and a zirconium oxide particle in which an aluminum compound (preferably aluminum oxide) is adhered to the surface, more preferably a titanium oxide particle in which acidic aluminum is adhered to the surface, and even more preferably a titanium dioxide particle in which aluminum oxide is adhered to the surface.

In a case where a pigment particle includes titanium oxide, a surface titanium proportion by the X-ray photoelectron spectroscopy is, for example, preferably 9.0 atom % or more and 15.0 atom % or less.

The surface titanium proportion is measured by XPS in the same method as in the surface aluminum proportion.

In a case where a pigment particle includes titanium oxide, a surface titanium proportion by the X-ray photoelectron spectroscopy is, for example, more preferably 9.0 atom % or more and 15.0 atom % or less and even more preferably 11.0 atom % or more and 13.0 atom % or less.

Properties of Pigment Particle

Particle Diameter

With respect to the pigment particle used in this exemplary embodiment, the number average primary particle diameter is, for example, preferably 170 nm or more and 400 nm or less and more preferably 240 nm or more and 330 nm or less.

The number average primary particle diameter of the pigment particle is measured by using a laser type particle diameter analyzer (NANOTRAC UPA-ST: manufactured by Nikkiso Co., Ltd.). As a measurement method, a sample is prepared by dissolving the toner in tetrahydrofuran, acetone, methyl ethyl ketone, toluene, or the like, collecting the pigment particles, and dispersing the pigment particles in ion exchanged water by using φ3.0 mm alumina beads, and measurement is performed by introducing this sample to a cell until the concentration becomes appropriate and leave this sample for two minutes. The particle diameter for each of the obtained channels is accumulated from the smaller number on a number basis, and a case where the accumulation reaches 50% is set as the number average primary particle diameter.

Particle Circularity

In view of suppressing the dropping of the pigment particle and suppressing the generation of the toner having a low charge amount, a proportion of the pigment particle having particle circularity of 0.90 or more in the pigment particle is, for example, preferably 65 number % or more, more preferably 70 number % or more, and even more preferably 75 number % or more.

The particle circularity is obtained by (perimeter equivalent to circle)/(perimeter) [(perimeter of circle having projected area which is the same as particle image)/(perimeter of projected particle image)]. Specifically, the particle circularity is a value obtained by the following method.

The proportion of the pigment particle having the particle circularity of 0.90 or more is obtained by the following method.

The circularity for each particle is measured by dissolving the toner in tetrahydrofuran, acetone, methyl ethyl ketone, toluene, or the like, collecting the pigment particles, observing the pigment particles to be measured with a scanning electron microscope (S-4100: manufactured by Hitachi, Ltd.) so as to a capture image, and performing image analysis of primary particles in this image by using image analysis software (Image J: manufactured by US National Institute of Health).

Then, a sampling number in obtaining the particle circularity is set to 500, and the proportion of pigment particles having a particle circularity degree of 0.90 or more out of 500 pigment particles is calculated.

Method of Manufacturing Pigment Particle

A method of obtaining a pigment particle having aluminum oxide on the surface is not particularly limited, and a well-known method is used. Examples thereof include a method of performing alumina coating by a wet treatment process disclosed in JP2015-525199A, JP1999-171541A (Alias, JP-H11-171541A), and the like.

Hereinafter, for example, a method of manufacturing a particle having aluminum oxide on the surface and including titanium dioxide is described.

For example, a particle having aluminum oxide on the surface and including titanium oxide is manufactured by attaching aluminum oxide on a surface of the titanium dioxide particle that does not have aluminum oxide on the surface.

The titanium dioxide particle may be a titanium dioxide particle obtained by any one of a sulfuric acid method and a chlorine method.

The circularity distribution or the average particle diameter of the titanium dioxide particles is adjusted to a desired range by a pulverization step or a classification step.

In a case where, after aluminum oxide is attached, the titanium dioxide particles are pulverized or classified, the circularity distribution and the particle diameter are adjusted as desired.

In the attaching of aluminum oxide, first, the titanium dioxide particles are dispersed in a solvent including water, a water soluble aluminum salt is added, and acid or base is added so as to control pH, such that hydrated aluminum oxide is precipitated on the surface of the titanium dioxide particles. Examples of the water soluble aluminum salt include sodium aluminate and aluminum sulfate. Examples of the used acid include hydrochloric acid, sulfuric acid, and nitric acid. Examples of the base include ammonia water, sodium hydroxide, and sodium phosphate.

After the coating, drying by heating is performed so as to cause hydrated aluminum oxide to be aluminum oxide, such that the titanium dioxide particle having aluminum oxide on the surface may be obtained.

In the step of precipitating hydrated aluminum oxide, the surface aluminum proportion and the surface titanium proportion in the titanium dioxide particle are controlled by controlling temperature, pH, and retention time.

In the pigment particles to be obtained, plural kinds of organic matters or inorganic metal hydroxide other than alumina may be caused to coexist. Examples of inorganic metal hydroxide include silica, zirconia, zinc oxide, antimony oxide, tin oxide, and cerium oxide. Examples of organic substances include a polyol-based compound such as trimethylolpropane and a polysilicon-based compound such as a silicone resin.

Content

The content of the pigment particle according to this exemplary embodiment is preferably 20 mass % or more and 60 mass % or less, more preferably 30 mass % or more and 50 mass % or less, and even more preferably 35 mass % or more and 45 mass % or less, for example, with respect to the total mass of the toner particle.

Binder Resin

The toner particle according to this exemplary embodiment includes a binder resin having a carboxy group.

Examples of the binder resin include a homopolymer of a monomer such as styrenes (for example, styrene, parachlorostyrene, and α-methylstyrene), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or a vinyl-based resin including a copolymer obtained by combining two or more of these monomers.

Examples of the binder resin include a non-vinyl based resin such as an epoxy resin, a polyester resin, a polyurethane resin, a polyamide resin, a cellulose resin, a polyether resin, and a modified rosin, a mixture of these and the vinyl-based resin, or a graft polymer obtained by polymerizing a vinyl-based monomer in the coexistence thereof.

These binder resins may be used singly or two or more kinds thereof may be used in combination.

In a case where the binder resin is a vinyl-based resin, a binder resin having a carboxy group can be obtained, for example, by using a monomer having an ethylenically unsaturated bond such as (meth)acrylic acid, itaconic acid, crotonic acid, and carboxystyrene and a carboxy group.

In a case where the binder resin is a polyester resin, for example, in a case where a polyester resin is produced from a condensation polymer of polyvalent carboxylic acid and polyhydric alcohol, the total amount of the carboxy group included in the polyvalent carboxylic acid used is caused to be greater than the total amount of the hydroxy group included in the polyhydric alcohol used, so as to obtain a binder resin with a carboxy group.

Acid Value

For example, the acid value of the binder resin is preferably 5 mgKOH/g or more and 18 mgKOH/g or less, more preferably 7 mgKOH/g or more and 16 mgKOH/g or less, and even more preferably 9 mgKOH/g or more and 14 mgKOH/g or less.

The acid value of the binder resin is measured based on "JIS K 0070 1992 Test methods for acid value, saponification value, ester value, iodine value, hydroxyl value, and unsaponifiable matter of chemical products".

The binder resin is not particularly limited and is preferably a polyester resin.

Examples of the polyester resin include a well-known amorphous polyester resin. For the polyester resin, a crystalline polyester resin may be used together with an amorphous polyester resin. However, the crystalline polyester resin may be used in the range in which the content is 2 mass % or more and 40 mass % or less (for example, preferably 2 mass % or more and 20 mass % or less) with respect to the total binder resin.

The "crystallinity" of the resin does not mean a stepwise change of the endothermic amount in the differential scanning calorimetry (DSC) but means to have a definite endothermic peak, and specifically means that the half-width of the endothermic peak in a case of being measured at a temperature rising rate of 10 (° C./min) is within 10° C.

On the other hand, the "amorphous" of the resin means that the half-width exceeds 10° C., that the stepwise endothermic change is exhibited, or that a definite endothermic peak is not recognized.

Amorphous Polyester Resin

Examples of the amorphous polyester resin include a condensation polymer of polyvalent carboxylic acid and polyhydric alcohol. As the amorphous polyester resin, a commercially available product may be used, or a synthesized product may be used.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acid (such as cyclohexanedicarboxylic acid), aromatic dicarboxylic acid (for example, terephthalic acid, isophthalic acid, phthalic acid, and naphthalene dicarboxylic acid), anhydrides thereof, or lower alkyl ester (for example, having 1 to 5 carbon atoms) thereof. Among these, as the polyvalent carboxylic acid, for example, aromatic dicarboxylic acid is preferable.

As the polyvalent carboxylic acid, trivalent or higher valent carboxylic acid having a crosslinked structure or a branched structure may be used together with the dicarboxylic acid. Examples of the trivalent or higher valent carboxylic acid include trimellitic acid, pyromellitic acid, anhydrides thereof, or lower alkyl esters (for example, having 1 to 5 carbon atoms) thereof.

The polyvalent carboxylic acid may be used singly or two or more kinds thereof may be used in combination.

Examples of the polyhydric alcohol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A and a propylene oxide adduct of bisphenol A). Among these, as the polyhydric alcohol, for example, aromatic diol or alicyclic diol is preferable, and aromatic diol is more preferable.

As the polyhydric alcohol, trihydric or higher hydric polyhydric alcohol having a crosslinked structure or a branched structure may be used together with diol. Examples of trihydric or higher hydric polyhydric alcohol include glycerin, trimethylolpropane, and pentaerythritol.

The polyhydric alcohol may be used singly or two or more kinds thereof may be used in combination.

The glass transition temperature (Tg) of the amorphous polyester resin is, for example, preferably 50° C. or more and 80° C. or less and more preferably 50° C. or more and 65° C. or less.

The glass transition temperature is calculated from the DSC curve obtained by the differential scanning calorimetry (DSC), more specifically, is obtained from "Extrapolated glass transition onset temperature" disclosed in the method of obtaining the glass transition temperature of "Method of measuring transition temperature of plastic" of JIS K 7121-1987.

For example, the weight-average molecular weight (Mw) of the amorphous polyester resin is preferably 5,000 or more and 1,000,000 or less and more preferably 7,000 or more and 500,000 or less.

The number-average molecular weight (Mn) of the amorphous polyester resin is preferably 2,000 or more and 100,000 or less, for example.

For example, the molecular weight distribution Mw/Mn of the amorphous polyester resin is preferably 1.5 or more and 100 or less and more preferably 2 or more and 60 or less.

The weight-average molecular weight and the number-average molecular weight are measured by gel permeation chromatography (GPC). Measuring of the molecular weight by GPC is performed in a THF solvent by using GPC•HLC-8120 GPC manufactured by Tosoh Corporation as a measuring device and using TSK gel SuperHM-M (15 cm) manufactured by Tosoh Corporation. The weight-average molecular weight and the number-average molecular weight are calculated by using a molecular weight calibration curve prepared from a monodispersed polystyrene standard sample from this measurement result.

The polyester resin may be obtained by the well-known manufacturing method. Specifically, the polyester resin may be obtained, for example, by the method of setting the polymerization temperature to be 180° C. or more and 230° C. or less, depressurizing the inside of the reaction system if necessary, and performing the reaction while removing water and alcohol generated during the condensation.

In a case where the monomer of the raw material does not dissolve or compatibilize at the reaction temperature, a solvent having a high boiling point may be added as a dissolution aid for dissolving. In this case, the polycondensation reaction is performed while the dissolution aid is distilled off. In a case where a monomer with bad compatibility is present, the monomer having bad compatibility and the acid or alcohol to be polycondensed with the monomer may be condensed with each other in advance, so as to be polycondensed with the major component.

Crystalline Polyester Resin

Examples of the crystalline polyester resin include a polycondensate of polyvalent carboxylic acid and polyhydric alcohol. As the crystalline polyester resin, a commercially available product may be used, or a synthesized product may be used.

Here, in order to easily form a crystal structure, although not particularly limited, the crystalline polyester resin is preferably a polycondensate by using a polymerizable monomer having a linear aliphatic group rather than an aromatic polymerizable monomer.

Examples of the polycarboxylic acid include aliphatic dicarboxylic acid (for example, oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acid (for example, dibasic acids such as phthalic acid, isophthalic acid, terephthalic acid, and naphthalene-2,6-dicarboxylic acid), an anhydride thereof, or lower alkyl esters thereof (for example, having 1 to 5 carbon atoms).

As the polyvalent carboxylic acid, trivalent or higher valent carboxylic acid having a crosslinked structure or a branched structure may be used together with the dicarboxylic acid. Examples of the trivalent carboxylic acid include aromatic carboxylic acid (for example, 1,2,3-benzenetricarboxylic acid, 1,2,4-benzenetricarboxylic acid, and 1,2,4-naphthalene tricarboxylic acid), an anhydride thereof, or lower alkyl ester (for example, having 1 to 5 carbon atoms).

As the polycarboxylic acid, dicarboxylic acid having a sulfonic acid group and dicarboxylic acid having an ethylenic double bond may be used together with these dicarboxylic acids.

The polyvalent carboxylic acid may be used singly or two or more kinds thereof may be used in combination.

Examples of the polyhydric alcohol include aliphatic diol (for example, linear aliphatic diol having a carbon number of 7 or more and 20 or less in a major chain moiety). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosandecanediol. Among these, for example, the aliphatic diol is preferably 1,8-octanediol, 1,9-nonanediol and 1,10-decanediol.

As the polyhydric alcohol, trihydric or higher hydric alcohol having a crosslinked structure or a branched structure may be used together with diol. Examples of trihydric or higher hydric alcohol include glycerin, trimethylolethane, trimethylolpropane, and pentaerythritol.

The polyhydric alcohol may be used singly or two or more kinds thereof may be used in combination.

Here, in the polyhydric alcohol, for example, the content of the aliphatic diol is preferably 80 mol % or more and preferably 90 mol % or more.

The melting temperature of the crystalline polyester resin is preferably 50° C. or more and 100° C. or less, more preferably 55° C. or more and 90° C. or less, and even more preferably 60° C. or more and 85° C. or less, for example.

The melting temperature is calculated from the DSC curve obtained by the differential scanning calorimetry (DSC) by "Melting peak temperature" disclosed in the method of obtaining the melting temperature of "Method of measuring transition temperature of plastic" of JIS K 7121-1987.

For example, the weight-average molecular weight (Mw) of the crystalline polyester resin is preferably 6,000 or more and 35,000 or less.

For example, the crystalline polyester resin can be obtained by the well-known manufacturing method in the same manner as the amorphous polyester resin.

For example, the content of the binder resin is preferably 40 mass % or more and 95 mass % or less, more preferably 50 mass % or more and 90 mass % or less, and even more preferably 60 mass % or more and 85 mass % or less with respect to the entire toner particle.

Colorant

Examples of the colorant include various pigments such as carbon black, chrome yellow, hansa yellow, benzidine yellow, suren yellow, quinoline yellow, pigment yellow, permanent orange GTR, pyrazolone orange, vulcan orange, watch young red, permanent red, brilliant carmine 3B, brilliant carmine 6B, dupont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and dyes such as acridine-based, xanthene-based, azo-based, benzoquinone-based, azine-based, anthraquinone-based, thioindigo-based, dioxazine-based, thiazine-based, azomethine-based, indico-based, phthalocyanine-based, aniline black-based, polymethine-based, triphenyl methane-based, diphenylmethane-based, and thiazole-based dyes.

The colorant may be used singly or two or more kinds thereof may be used in combination.

As the colorant, if necessary, a surface-treated colorant may be used or a dispersing agent may be used in combination. Plural colorants may be used in combination.

For example, the content of the colorant is preferably 1 mass % or more and 30 mass % or less and more preferably 3 mass % or more and 15 mass % or less with respect to the entire toner particle.

Releasing Agent

Examples of the releasing agent include hydrocarbon wax; natural wax such as carnauba wax, rice wax, and candelilla wax; synthetic or mineral/petroleum wax such as montan wax; and ester type wax such as fatty acid ester and montanic acid ester.

In view of suppressing the generation of the toner having a low charge amount, although not particularly limited, the releasing agent is preferably paraffinic hydrocarbon and more preferably paraffinic hydrocarbon having 30 to 70 carbon atoms.

The paraffinic hydrocarbon may be linear or branched.

The melting temperature of the releasing agent is, for example, preferably 50° C. or more and 110° C. or less and more preferably 60° C. or more and 100° C. or less.

The melting temperature is calculated from the DSC curve obtained by the differential scanning calorimetry (DSC) by "Melting peak temperature" disclosed in the method of obtaining the melting temperature of "Method of measuring transition temperature of plastic" of JIS K 7121-1987.

For example, the content of the releasing agent is preferably 0.1 mass % or more and 9.0 mass % or less and more preferably 3 mass % or more and 7 mass % or less with respect to the entire toner particle.

Other Additives

Examples of other additives include well-known additives such as a magnetic material, a charge control agent, and an inorganic powder. These additives are included in the toner particle as an internal additive.

Properties of Toner Particle

The toner particle may be a toner particle of a single layer structure or may be a toner particle of a so-called core-shell structure including a core part (core particle) and a coating layer (shell layer) coating the core part.

Here, the toner particles having a core-shell structure may include, for example, by a core portion including a binder resin and, if necessary, other additives such as a colorant and a releasing agent and a coating layer including a binder resin.

The volume average particle diameter (D50v) of the toner particle is preferably 2 μm or more and 10 μm or less and more preferably 4 μm or more and 8 μm or less, for example.

The various volume average particle diameters and various particle diameter distribution indexes of the toner particles are measured using COULTER MULTISIZER II (manufactured by Beckman Coulter, Inc.) and using ISOTON-II (manufactured by Beckman Coulter, Inc.) as an electrolytic solution.

In the measurement, 0.5 mg or more and 50 mg or less of a measurement sample is added to 2 ml of a 5% aqueous solution of a surfactant (for example, preferably sodium alkylbenzenesulfonate) as a dispersing agent. This is added to 100 ml or more and 150 ml or less of the electrolytic solution.

A dispersion treatment of the electrolytic solution in which the sample is suspended is performed for one minute with an ultrasonic disperser, and the particle diameter distribution of the particle having a particle diameter in the range of 2 μm or more and 60 μm or less is measured by using an aperture having an aperture diameter of 100 μm by COULTER MULTISIZER II. The number of sampling particles is 50,000.

The cumulative distribution of the volume and the number is drawn from the small diameter side with respect to the divided particle diameter range (channel) based on the measured particle diameter distribution, the particle diameter at which the accumulation becomes 16% is defined as a volume particle diameter D16v and a number particle diameter D16p, the particle diameter at which the accumulation becomes 50% is defined as a volume average particle diameter D50v and a cumulative number average particle diameter D50p, and the particle diameter at which the accumulation becomes 84% is defined as a volume particle diameter D84v and a number particle diameter D84p.

By using these, the volume particle diameter distribution index (GSDv) is calculated as $(D84v/D16v)^{1/2}$, and the number particle diameter distribution index (GSDp) is calculated as $(D84p/D16p)^{1/2}$.

The average circularity of the toner particle is preferably 0.94 or more and 1.00 or less and more preferably 0.95 or more and 0.98 or less, for example.

The average circularity of the toner particle is obtained by (perimeter equivalent to circle)/(perimeter) [(perimeter of circle having projected area which is the same as particle image)/(perimeter of projected particle image)]. Specifically, the particle circularity is a value obtained by the following method.

First, toner particles to be measured are sucked and collected, a flat flow is formed, stroboscopic light is instantaneously emitted so as to capture a particle image as a still image, and a flow type particle image analyzer (FPIA-2100 manufactured by Sysmex Corporation) which performs image analysis on the particle image, so as to obtain the average circularity. Then, the sampling number in a case of determining the average circularity is set as 3,500.

In a case where the toner has an external additive, a toner (developer) to be measured is dispersed in water including a surfactant, and an ultrasonic treatment is performed, so as to obtain a toner particle from which an external additive has been removed.

External Additives

Examples of the external additive include an inorganic particle. Examples of the other inorganic particle include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surface of the inorganic particle as the external additive may be subjected to the hydrophobic treatment. For example, the hydrophobic treatment is performed by immersing an inorganic particle to the hydrophobic treatment agent, or the like. The hydrophobic treatment agent is not particularly limited, but examples thereof include a silane coupling agent, a silicone oil, a titanate coupling agent, and an aluminum coupling agent. These may be used singly or two or more kinds thereof may be used in combination.

For example, the amount of the hydrophobic treatment agent is generally 1 part by mass or more and 10 parts by mass or less with respect to 100 parts by mass of the inorganic particle.

Examples of the other external additive include a resin particle (a resin particle such as polystyrene, polymethyl methacrylate (PMMA), and melamine resin) and a cleaning activator (for example, metal salt of higher fatty acid represented by zinc stearate and a particle of a fluorine-based high molecular weight substance).

The content of the external additive is preferably 0.01 mass % or more and 5 mass % or less and more preferably 0.01 mass % or more and 2.0 mass % or less with respect to the toner particle, for example.

Method of Manufacturing Toner

Subsequently, a method of manufacturing the toner according to this exemplary embodiment is described.

The toner according to this exemplary embodiment may be obtained by externally adding an external additive to the toner particle after the toner particle is manufactured.

The toner particle may be manufactured by any one of a dry process (for example, a kneading pulverization method) and a wet process (for example, an aggregation coalescence method, a suspension polymerization method, and a dissolution suspension method). A method of manufacturing the toner particle is not particularly limited, and well-known processes are employed.

Among these, toner particles may be obtained by a coagulation coalescence method.

Specifically, for example, in a case where toner particles are manufactured by an aggregation coalescence method, the toner particles are manufactured by the toner particles are manufactured through a step of (a resin particle dispersion preparation step) of preparing a resin particle dispersion in which resin particles to be a binder resin are dispersed, a step of aggregating the resin particles (other particles, if necessary) in the resin particle dispersion (in a dispersion after other particles are mixed, if necessary) to form aggregated particles, and a step (coagulation/coalescence step) of heating the aggregated particle dispersion in which the aggregated particles are dispersed, and coagulating and coalescing the aggregated particles to form toner particles.

Hereinafter, respective steps are described.

In the following description, a method for obtaining toner particles including a colorant and a releasing agent is described, but a colorant and a releasing agent are used, if necessary. It is obvious that, other additives other than the colorant and the releasing agent may be used.

Resin Particle Dispersion Preparation Step

Together with the resin particle dispersion in which resin particles to be a binder resin are dispersed, for example, a colorant particle dispersion in which colorant particles are dispersed and a releasing agent particle dispersion in which releasing agent particles are dispersed are prepared.

Here, the resin particle dispersion is prepared, for example, by dispersing resin particles in a dispersion medium by a surfactant.

Examples of the dispersion medium used for the resin particle dispersion include an aqueous medium.

Examples of the aqueous medium include water such as distilled water and ion exchanged water and alcohols. These may be used singly or two or more kinds thereof may be used in combination.

Examples of the surfactant include an anionic surfactant such as sulfate ester salt-based, sulfonate-based, phosphate ester-based, and soap-based surfactants; a cationic surfactant such as amine salt-based and quaternary ammonium salt-based surfactants; and a nonionic surfactant such as polyethylene glycol-based, alkylphenol ethylene oxide adduct-based, and polyhydric alcohol-based surfactants. Among these, particularly, an anionic surfactant and a cationic surfactant are exemplified. The nonionic surfactant may be used together with an anionic surfactant and a cationic surfactant.

The surfactant may be used singly or two or more kinds thereof may be used in combination.

With respect to the resin particle dispersion, examples of the method of dispersing the resin particles in a dispersion medium, for example, include a general dispersing method such as a rotary shearing type homogenizer, a ball mill, a sand mill, and a dyno mill having a medium. According to the types of the resin particle, for example, the resin particle may be dispersed in the resin particle dispersion by a phase-transfer emulsification method.

The phase-transfer emulsification method is a method of dispersing the resin in an aqueous medium in a particle form by dissolving the resin to be dispersed in a hydrophobic organic solvent in which the resin is soluble, adding a base to an organic continuous phase (O phase) for neutralization, introducing the aqueous medium (W phase), and performing conversion (so-called phase inversion) of the resin from W/O to O/W, so as form a discontinuous phase.

The volume average particle diameter of the resin particle dispersed in the resin particle dispersion is preferably 0.01 μm or more and 1 μm or less, more preferably 0.08 μm or more and 0.8 μm or less, and even more preferably 0.1 μm or more and 0.6 μm or less, for example.

With respect to the volume average particle diameter of the resin particles, the particle diameter which becomes 50% of the accumulation with respect to all the particles is defined as the volume average particle diameter D50v is measured as the volume average particle diameter D50v, by subtracting the cumulative distribution from the small particle diameter side to the volume with respect to the particle size (channel) partitioned by using the particle size distribution obtained by measurement with a laser diffraction type particle size distribution determination device (for example, LA-700, manufactured by Horiba, Ltd.). The volume average particle diameter of the particles in other dispersions is measured in the same manner.

For example, the content of the resin particle of the resin particle dispersion is preferably 5 mass % or more and 50 mass % or less and more preferably 10 mass % or more and 40 mass % or less.

In the same manner as the resin particle dispersion, for example, a colorant dispersion and a releasing agent particle dispersion are also prepared. That is, with regard to the volume average particle diameter of the particles in the resin particle dispersion, the dispersion medium, the dispersion method, and the content of the particles, the same is applied to the releasing agent particles dispersed in the colorant particles dispersed in the colorant particle dispersion and the releasing agent particle dispersion.

Aggregated Particle Forming Step

Subsequently, the colorant dispersion and the releasing agent particle dispersion are mixed together with the resin particle dispersion.

In the mixed dispersion, the resin particles, the colorant, and the releasing agent particles are heteroaggregated and aggregated particles including the resin particles, the colorant, and the releasing agent particles which has a diameter close to the diameter of the target toner particle are formed.

Specifically, for example, an aggregating agent is added to the mixed dispersion, pH of the mixed dispersion is adjusted to acidity (for example, pH 2 or more and 5 or less), a dispersion stabilizer is added, if necessary, heating is performed to a temperature of the glass transition temperature (specifically, for example, glass transition temperature of resin particles −30° C. or more and glass transition temperature −10° C. or less) of the resin particles, and the particles dispersed in the mixed dispersion are aggregated, so as to form aggregated particles.

In the aggregated particle forming step, for example, heating may be performed after adding an aggregating agent at room temperature (for example, 25° C.) under the mixed dispersion is stirred with a rotary shearing type homogenizer, adjusting pH of the mixed dispersion to acidity (for example, pH 2 or more and 5 or less), and adding the dispersion stabilizer, if necessary.

Examples of the aggregating agent include a surfactant having a polarity opposite to that of a surfactant used as a dispersant to be added to the mixed dispersion, inorganic metal salt, and a divalent or higher valent metal complex. Particularly, in a case where a metal complex is used as the aggregating agent, the amount of the surfactant used is reduced and the chargeability is improved.

An additive that forms a complex or a similar bond with a metal ion of the aggregating agent may be used, if necessary. As the additive, a chelating agent may be used.

Examples of the inorganic metal salt include metal salt such as calcium chloride, calcium nitrate, barium chloride, magnesium chloride, zinc chloride, aluminum chloride, and aluminum sulfate; and an inorganic metal salt polymer such as polyaluminum chloride, poly aluminum hydroxide, and calcium polysulfide polymer.

As the chelating agent, a water soluble chelating agent may be used. Examples of the chelating agent include oxycarboxylic acid such as tartaric acid, citric acid, and gluconic acid; iminodiacetic acid (IDA), nitrilotriacetic acid (NTA), and ethylenediaminetetraacetic acid (EDTA).

For example, the addition amount of the chelating agent is preferably 0.01 parts by mass or more and 5.0 parts by mass or less and more preferably 0.1 parts by mass or more and less than 3.0 parts by mass with respect to 100 parts by mass of the resin particle.

Coagulation Coalescence Step

Next, the aggregated particle dispersion in which the aggregated particles are dispersed is heated, for example, to be equal to or higher than the glass transition temperature (for example, the temperature higher than the glass transition temperature of the resin particles by 10° C. to 30° C. or higher) of the resin particles, and the aggregated particles are coagulated and coalesced, so as to form the toner particle.

The toner particles may be obtained through the above steps.

The toner particles may be manufactured through a step of obtaining an aggregated particle dispersion in which the aggregated particles are dispersed, further mixing the aggregated particle dispersion and the resin particle dispersion in which the resin particles are dispersed, and aggregating such that the resin particles are further adhered to the surface of the aggregated particles, to form the second aggregated particles and a step of heating the second aggregated particle dispersion in which the second aggregated particles are dispersed, and coagulating and coalescing of the second aggregated particles, to form toner particles having a core-shell structure.

Here, after completion of the coagulation coalescence step, a well-known washing step, a well-known solid-liquid separation step, and a well-known drying step are performed on to the toner particles formed in the solution, so as to obtain toner particles in a dry state.

With respect to the washing step, in view of chargeability, displacement washing with ion exchanged water may be sufficiently performed. The solid-liquid separation step is not particularly limited, but suction filtration, pressure filtration, and the like may be performed, in view of productivity. The drying step is not particularly limited, but freeze-drying, air stream drying, viscous flow drying, vibrating viscous drying, and the like may be performed, in view of productivity.

Then, the toner according to this embodiment is manufactured, for example, by adding an external additive to the obtained toner particles in a dry state and performing mixing. The mixing may be performed, for example, a V blender, a HENSCHEL mixer, or a LOEDIGE mixer. If necessary, coarse particles of the toner may be removed by using a vibration sieving machine, an air sieve separator, or the like.

Electrostatic Charge Image Developer

The electrostatic charge image developer according to this exemplary embodiment at least includes the toner according to this exemplary embodiment.

The electrostatic charge image developer according to this exemplary embodiment may be a single component developer including only the toner according to this exemplary embodiment and may be a double component developer obtained by mixing the toner and a carrier.

The carrier is not particularly limited, and examples thereof include well-known carriers. Examples of the carrier include a coated carrier in which the surface of a core formed of magnetic powder is coated with a coating resin; a magnetic powder dispersed carrier formulated by dispersing in which magnetic powder in a matrix resin; and a resin impregnated carrier in which porous magnetic powder is impregnated with a resin.

The magnetic powder dispersion type carrier and the resin impregnation type carrier may be a carrier obtained by using constituent particles of the carrier as a core and coating the surface with a coating resin.

Examples of the magnetic powder include magnetic metal such as iron, nickel, and cobalt; and magnetic oxides such as ferrite and magnetite.

Examples of the coating resin and the matrix resin include polyethylene, polypropylene, polystyrene, polyvinyl acetate, polyvinyl alcohol, polyvinyl butyral, PVC, polyvinyl ether, polyvinyl ketone, a vinyl chloride-vinyl acetate copolymer, a styrene-acrylic acid ester copolymer, a straight silicone resin including an organosiloxane bond, or modified products thereof, a fluorine resin, polyester, polycarbonate, a phenol resin, and an epoxy resin.

Other additives such as conductive particles may be included in the coating resin and the matrix resin.

Examples of the conductive particles include particles of metal such as gold, silver, and copper, carbon black, titanium oxide, zinc oxide, tin oxide, barium sulfate, aluminum borate, and potassium titanate.

Here, in order to coat the surface of the core with the coating resin, a method of applying the coating resin and a coating layer forming solution obtained by dissolving various additives (used, if necessary) in an appropriate solvent, if necessary, and the like may be exemplified. The solvent is not particularly limited and may be selected considering the resin to be used, coating suitability, and the like.

Specific examples of the resin coating method include an immersion method of immersing the core in a coating layer forming solution; a spraying method of spraying a coating layer forming solution to the surface of the core material; a viscous flow bed method of spraying the coating layer forming solution in a state in which the core is suspended by viscous flow air; and a kneader coater method of mixing a core of a carrier and a coating layer forming solution in a kneader coater and then removing the solvent.

The mixing ratio (mass ratio) of the toner and the carrier in the double-component developer is preferably from toner: carrier=1:100 to 30:100 and more preferably from 3:100 to 20:100, for example.

Image Forming Device and Image Forming Method

An image forming device and an image forming method according to this exemplary embodiment are described.

The image forming device according to this exemplary embodiment includes an image holding member, a charging unit that charges a surface of the image holding member, an electrostatic charge image forming unit that forms an electrostatic charge image on the charged surface of the image holding member, a developing unit that accommodates an electrostatic charge image developer and developing an electrostatic charge image formed on the surface of the image holding member by the electrostatic charge image developer as a toner image, a transfer unit that transfers a toner image formed on the surface of the image holding member to a surface of a recording medium, and a fixing unit that fixes the toner image transferred to the surface of the recording medium. As the electrostatic charge image developer, an electrostatic charge image developer according to this exemplary embodiment is applied.

In the image forming device according to this exemplary embodiment, an image forming method (the image forming method according to this exemplary embodiment) including a charging step of charging a surface of the image holding member, an electrostatic charge image forming step of forming an electrostatic charge image on the charged surface of the image holding member, an developing step of developing an electrostatic charge image formed on the surface of the image holding member by the electrostatic charge image developer according to this exemplary embodiment as a toner image, a transfer step of transferring a toner image formed on the surface of the image holding member to a surface of a recording medium, and a fixing step of fixing the toner image transferred to the surface of the recording medium is performed.

With respect to the image forming device according to this exemplary embodiment, well-known image forming devices such as a device in a direct transfer method of directly transferring a toner image formed on a surface of an image holding member to a recording medium; a device in an intermediate transfer method of firstly transferring a toner image formed on a surface of an image holding member to a surface of an intermediate transfer member and secondarily transferring the toner image transferred to the surface of the intermediate transfer member to the surface of the recording medium; a device of including a cleaning unit that cleans the surface of the image holding member after transferring of the toner image and before charging; and a device of including a discharging unit that performs discharging by irradiating the surface of the image holding member with discharging light after the transferring of the toner image and before charging.

In a case of a device in the intermediate transferring method, a configuration in which the transfer unit, for example, includes an intermediate transfer member in which a toner image is transferred to a surface, a primary transfer unit that firstly transfers the toner image formed on the surface of the image holding member to a surface of the intermediate transfer member, and a secondary transfer unit that secondarily transfers the toner image transferred to the surface of the intermediate transfer member to a surface of a recording medium is applied.

In the image forming device according to this exemplary embodiment, for example, a portion including a developing unit may be a cartridge structure (process cartridge) that is detachably attached to the image forming device. As the process cartridge, for example, a process cartridge including a developing unit that accommodates an electrostatic charge image developer according to this exemplary embodiment may be used.

Hereinafter, an example of the image forming device according to this exemplary embodiment is described, but this exemplary embodiment is not limited thereto. In the description below, major portions illustrated in the drawings are described, and explanations of the others are omitted.

FIG. 1 is a schematic view illustrating the image forming device according to this exemplary embodiment.

The image forming device illustrated in FIG. 1 includes first to fourth image forming units 10Y, 10M, 10C, and 10K (image forming units) of an electrophotographic method that output images of respective colors of yellow (Y), magenta (M), cyan (C), and black (K) based on color separated image data. These image forming units (hereinafter, simply referred to as "units" in some cases) 10Y, 10M, 10C, and 10K are arranged to be parallel by being spaced in a predetermined distance from each other in a horizontal direction. These units 10Y, 10M, 10C, and 10K may be process cartridges that are detachably attached to the image forming device.

An intermediate transfer belt 20 as an intermediate transfer member extends through each unit on upper portions of the units 10Y, 10M, 10C, and 10K in the drawing. The intermediate transfer belt 20 is installed to be wound around a support roller 24 in contact with the inner surfaces of the drive roller 22 and the intermediate transfer belt 20 that are disposed to be spaced from each other and is driven in a direction from the first unit 10Y to the fourth unit 10K. The force is applied to the support roller 24 in a direction of departing from the drive roller 22 by a spring or the like, such that tension is applied to the intermediate transfer belt 20. An intermediate transfer member cleaning device 30 is provided on the side surface of the image holding member of the intermediate transfer belt 20 to face the drive roller 22.

Toners including toners of four colors of yellow, magenta, cyan, and black that are held in containers included in toner cartridges 8Y, 8M, 8C, and 8K are supplied to respective developing devices (developing units) 4Y, 4M, 4C, and 4K of the respective units 10Y, 10M, 10C, and 10K.

The first to fourth units 10Y, 10M, 10C, and 10K have identical configuration, and thus the first unit 10Y that is installed on an upper stream side in the intermediate transfer belt driving direction and forms a yellow image is representatively described. The reference numerals to which magenta (M), cyan (C), and black (K) are added to the same portions as the first unit 10Y instead of yellow (Y) are provided, and descriptions of the second to fourth units 10M, 10C, and 10K are omitted.

The first unit 10Y has a photoconductor 1Y that functions as an image holding member. Around the photoconductor 1Y, a charging roller (an example of the charging unit) 2Y that charges a surface of the photoconductor 1Y in a predetermined potential, an exposing device (an example of the electrostatic charge image forming unit) 3 that exposes the charged surface with laser beams 3Y based on a color separated image signal and forms an electrostatic charge image, a developing device (an example of the developing unit) 4Y that supplies a toner charged on an electrostatic charge image and develops an electrostatic charge image, a primary transfer roller 5Y (an example of the primary transfer unit) that transfers the developed toner image on the intermediate transfer belt 20, and a photoconductor cleaning device 6Y (an example of the cleaning unit) that removes the toner remaining on the surface of the photoconductor 1Y after primary transferring.

The primary transfer roller 5Y is disposed inside the intermediate transfer belt 20 and is provided at a position facing the photoconductor 1Y. Respective bias power supplies (not illustrated) that apply primary transfer bias are connected to the primary transfer rollers 5Y, 5M, 5C, and 5K of the respective units. The respective bias power supplies change the values of the transfer bias applied to the respective primary transfer rollers according to the control of a controller (not illustrated).

Hereinafter, movements for forming a yellow image in the first unit 10Y are described.

First, prior to the movements, the surface of the photoconductor 1Y is charged by the charging roller 2Y to a potential of −600 V to −800 V.

The photoconductor 1Y is formed by laminating a photosensitive layer on a substrate having conductivity (for example, volume resistivity at 20° C. of $1\times10^{-6}$ Ωcm or less). This photosensitive layer is generally high resistance (resistance of general resin), but has properties in which the specific resistance of the portion irradiated with the laser beams changes in a case where the photosensitive layer is irradiated with laser beams 3Y. Therefore, the laser beams 3Y is output through the exposing device 3 to the charged surface of the photoconductor 1Y according to image data for yellow sent from the controller (not illustrated). The photosensitive layer on the surface of the photoconductor 1Y is irradiated with the laser beam 3Y, and accordingly an electrostatic charge image of a yellow image pattern is formed on the surface of the photoconductor 1Y.

The electrostatic charge image is an image formed on the surface of the photoconductor 1Y by charging and is a so-called negative latent image in which the specific resistance of the irradiated portion of the photosensitive layer decreases by the laser beams 3Y such that the charged electric charged on the surface of the photoconductor 1Y flows and charges of the portion not irradiated with the laser beam 3Y are retained.

The electrostatic charge image formed on the photoconductor 1Y rotates to a predetermined developing position according to the driving of the photoconductor 1Y. In this developing position, the electrostatic charge image on the photoconductor 1Y becomes a visible image (developed image) as a toner image by the developing device 4Y.

The electrostatic charge image developer including at least a yellow toner and a carrier is accommodated in the developing device 4Y. The yellow toner is frictionally electrified by being stirred inside the developing device 4Y, and has charges having the polarity the same (negative polarity) as that of the charges charged on the photoconductor 1Y and is held on a roller (an example of developer holding member). As the surface of the photoconductor 1Y passes through the developing device 4Y, the yellow toner electrostatically adheres to the latent image portion discharged on the surface of the photoconductor 1Y, and the latent image is developed with the yellow toner. The photoconductor 1Y on which the yellow toner image is formed is subsequently moved at a predetermined speed, and the toner image developed on the photoconductor 1Y is transported to a predetermined primary transfer position.

In a case where the yellow toner image on the photoconductor 1Y is transported to the primary transfer, a primary transfer bias is applied to the primary transfer roller 5Y, the electrostatic force directed from the photoconductor 1Y toward the primary transfer roller 5Y acts on the toner image, and the toner image on the photoconductor 1Y is transferred to the intermediate transfer belt 20. The transfer bias applied at this point has a polarity (+) opposite to the polarity (−) of the toner and is controlled to +10 μA, for example, by the controller (not illustrated) in the first unit 10Y.

Meanwhile, the toner retained on the photoconductor 1Y is removed by the photoconductor cleaning device 6Y and collected.

The primary transfer bias applied to the primary transfer rollers 5M, 5C, and 5K after the second unit 10M is also controlled in accordance with the first unit.

In this manner, the intermediate transfer belt 20 to which the yellow toner image has been transferred in the first unit 10Y is transported sequentially through the second to fourth units 10M, 10C, and 10K, toner images of respective colors are superimposed and transferred in a multiplex manner.

The intermediate transfer belt 20 on which the four color toner images are transferred in a multiplex manner through the first to fourth units reaches a secondary transfer portion including an intermediate transfer belt 20, the support roller 24 in contact with the inner surface of the intermediate transfer belt, and a secondary transfer roller (an example of the secondary transfer unit) 26 disposed on the image holding surface side of the intermediate transfer belt 20. On the other hand, recording paper (an example of a recording medium) P is fed to the gap between the secondary transfer roller 26 and the intermediate transfer belt 20 via a supply mechanism at a predetermined timing, and the secondary transfer bias is applied to the support roller 24. The transfer bias applied at this point has a polarity (−) of polarity the same as the polarity (−) of the toner, and the electrostatic force directed from the intermediate transfer belt 20 toward the recording paper P acts on the toner image, and the toner image on the intermediate transfer belt 20 is transferred onto the recording paper P. The secondary transfer bias at this point is determined according to the resistance detected by a resistance detection unit (not illustrated) for detecting the resistance of the secondary transfer portion, and the voltage is controlled.

The recording paper P is transferred is sent to pressure contact portions (nip portions) of a pair of fixing rollers in a fixing device (an example of the fixing unit) 28, and a toner image is fixed on the recording paper P, and a fixed image is formed.

Examples of the recording paper P to which the toner image is transferred include plain paper used for a copying machine or a printer in the electrophotographic method. Examples of the recording medium include an OHP sheet in addition to the recording paper P.

In order to further improve the smoothness of the image surface after fixing, for example, it is preferable that the surface of the recording paper P is also smooth. For example, coated paper obtained by coating the surface of plain paper with a resin or the like, art paper for printing, and the like may be used.

The recording paper P on which fixing of the color image is completed is exported toward the discharging section, and the series of color image forming movements is ended.

Process Cartridge and Toner Cartridge

The process cartridge according to this exemplary embodiment is described.

The process cartridge according to this exemplary embodiment is a process cartridge that includes a developing unit accommodating the electrostatic charge image developer according to this exemplary embodiment and developing an electrostatic charge image formed on the surface of the image holding member by the electrostatic charge image developer as the toner image and that is detachably attached to the image forming device.

The process cartridge according to this exemplary embodiment is not limited to the configuration and may have a configuration of including a developing device and, for example, at least one selected from other units such as an image holding member, a charging unit, an electrostatic charge image forming unit, and a transfer unit, if necessary.

Hereinafter, an example of the process cartridge according to this exemplary embodiment is described, but the present invention is not limited thereto. In the description below, major portions illustrated in the drawings are described, and explanations of the others are omitted.

Figure 2:
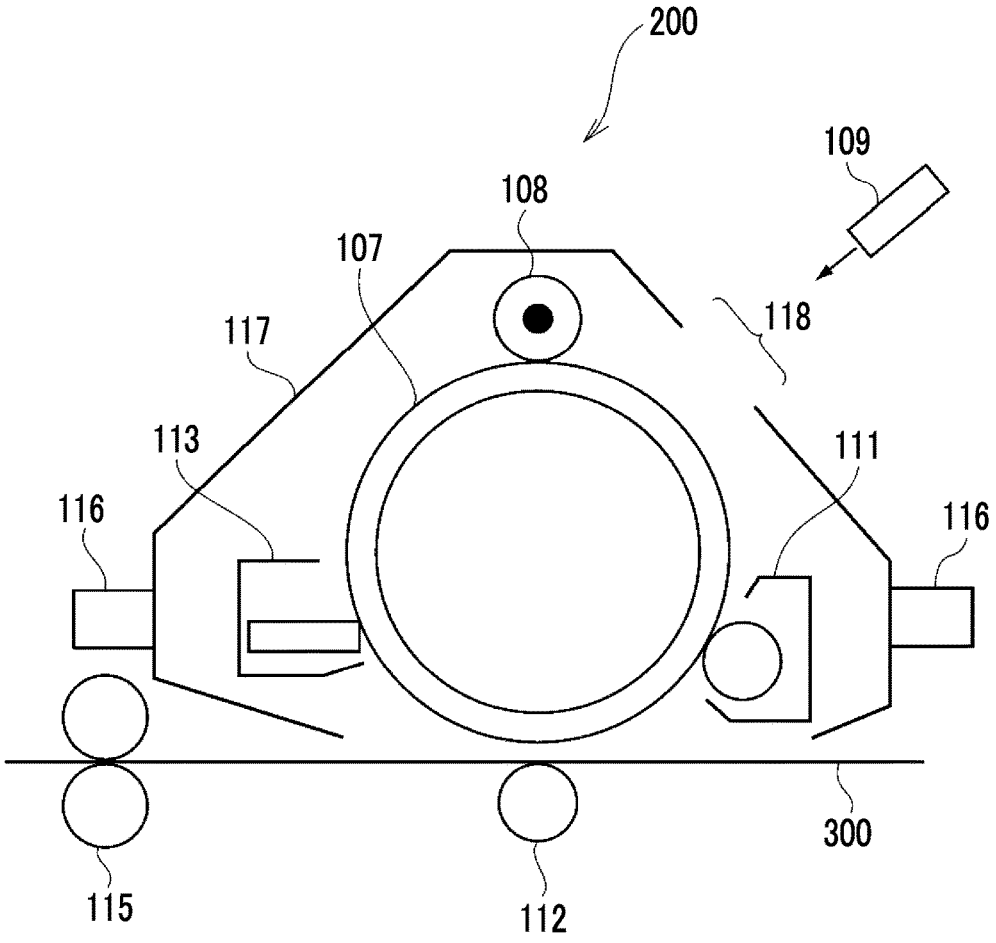
FIG. 2 is a schematic view illustrating a configuration of a process cartridge according to this exemplary embodiment.

FIG. 2 is a schematic view illustrating a configuration of a process cartridge according to this exemplary embodiment.

A process cartridge 200 illustrated in FIG. 2 became a cartridge combining and holding a photoconductor 107 (an example of the image holding member), a charging roller 108 (an example of the charging unit) around the photoconductor 107, a developing device 111 (an example of the developing unit), and a photoconductor cleaning device 113 (an example of the cleaning unit) in an integrated manner, for example, by a housing 117 including a mounting rail 116 and an opening 118 for exposure.

In FIG. 2, 109 indicates an exposing device (an example of the electrostatic charge image forming unit), 112 indicates a transfer device (an example of the transfer unit), 115 indicates a fixing device (an example of the fixing unit), and 300 indicates a recording paper (an example of the recording medium).

Subsequently, the toner cartridge according to this exemplary embodiment is described.

The toner cartridge according to this exemplary embodiment is a toner cartridge that includes a container that accommodates the toner according to this exemplary embodiment and is detachably attached to the image forming device. The toner cartridge includes the container that accommodates the replenishing toner for being supplied to the developing unit provided in the image forming device.

The image forming device illustrated in FIG. 1 is an image forming device having a configuration in which the toner cartridges 8Y, 8M, 8C, and 8K are detachably attached, and the developing devices 4Y, 4M, 4C, and 4K are connected to the toner cartridges corresponding to the respective developing devices (colors) by toner supply tubes (not illustrated). In a case where the toner that is accommodated in the container in the toner cartridge becomes less, this toner cartridge is replaced.

EXAMPLES

Hereinafter, details of this exemplary embodiment are specifically described with reference to the examples, but this exemplary embodiment is not limited to these examples. In the following description, unless specified otherwise, all of "part" and "%" are based on mass.

Example 1

Manufacturing of Pigment Particle 1 kg of a titanium dioxide particle which is obtained by the chlorine method and in which a proportion of a particle having a particle circularity of 0.90 or more is 65.4% with respect to the entire particle and an average particle diameter is 260 nm is mixed with 4 L of pure water, and stirred so as to prepare a titanium dioxide particle dispersion. The titanium dioxide particle dispersion is maintained to be at 50° C. to 70° C., 30% sulfuric acid and 20% sodium hydroxide are added such that the pH of the dispersion becomes 6.5, and 150 g of an aqueous sodium silicate solution including 10% in terms of silica are added, such that the mixture is maintained for two hours. Thereafter, 180 g of an aqueous sodium aluminate solution containing 20% in terms of alumina is added, and the mixture is maintained for 30 minutes. Thereafter, 30% sulfuric acid is added, the pH is readjusted to 5.5, and the mixture is maintained at 60° C. to 75° C. for one hour. The obtained titanium dioxide particle dispersion after the sodium aluminate treatment is filtered, and the solid matter is washed with a certain amount of pure water and then is dried in an oven at 130° C. for 24 hours. The dried product is pulverized by a hammer type pulverizer so as to obtain a titanium dioxide pigment particle having aluminum oxide on the surface thereof.

A surface aluminum proportion, a surface titanium proportion, a proportion of a pigment particle having a particle circularity of 0.90 or more, a surface aluminum oxide proportion, a number average primary particle diameter, and an aluminum proportion in an entire pigment particle in the titanium dioxide pigment particle having aluminum oxide on the obtained surface is described in Table 1.

Manufacturing of Pigment Particle Dispersion

| | |
|---|---|
| Titanium dioxide pigment particle having aluminum oxide on surface: | 200 parts |
| Anionic surfactant (TAYCA POWER, BN 2060, active ingredient amount: 60%): | 17 parts |
| Ion exchange water: | 450 parts |

The above components are mixed and stirred for 30 minutes using a homogenizer (ULTRA-TURRAX T50: manufactured by IKA-Werke GmbH & Co. KG) and are subjected to a dispersion treatment in a high pressure impact type dispersing machine ULTIMIZER (HJP30006: manufactured by Sugino Machine Limited) for one hour, so as to obtain a pigment particle dispersion (solid content proportion: 30%) in which the titanium oxide pigment is dispersed.

Manufacturing of Resin Particle Dispersion (1)

| | |
|---|---|
| Terephthalic acid: | 30 parts by mole |
| Fumaric acid: | 68 parts by mole |
| Bisphenol A ethylene oxide adduct: | 5 parts by mole |
| Bisphenol A propylene oxide adduct: | 95 parts by mol |

The materials are introduced to a flask having a content of 5 liters, which is equipped with a stirrer, a nitrogen introduction pipe, a temperature sensor, and a rectification column, the temperature is raised to 210° C. over one hour, and 1 part of titanium tetraethoxide with respect to 100 parts of the material is introduced. While produced water is distilled, the temperature is raised to 230° C. over 0.5 hours, the dehydration condensation reaction is continued for one hour at the temperature, and the reaction product is cooled. In this manner, the polyester resin having an acid value of 12.2 mgKOH/g is synthesized.

40 parts of ethyl acetate and 25 parts of 2-butanol are introduced into a container equipped with a temperature regulating unit and a nitrogen replacing unit to obtain a mixed solvent, 100 parts of a polyester resin is gradually added and dissolved, and 10 mass % of an aqueous ammonia solution (equivalent to 3 times by the molar ratio with respect to the acid value of the resin) are put, and stirring is performed over 30 minutes.

Subsequently, the inside of the container is replaced with dry nitrogen, the temperature is maintained at 40° C., and 400 parts of ion exchanged water is added dropwise at a rate of 2 parts/min while the mixed solution is stirred. After the dropwise addition is completed, the temperature of the emulsion is returned to room temperature (20° C. to 25° C.), and bubbling is performed for 48 hours with dry nitrogen while stirring, so as to obtain a resin particle dispersion in which ethyl acetate and 2-butanol are reduced to 1,000 ppm or less, and the resin particle having a volume average particle diameter of 200 nm is dispersed. Ion exchanged water is added to the resin particle dispersion, and the solid content is adjusted to 30 mass %, so as to obtain a resin particle dispersion (1).

The acid value and the weight average molecular weight in the obtained binder resin are presented in Table 1.

Preparation of Releasing Agent Dispersion

| | |
|---|---|
| Paraffin wax (Nippon Seiro Co., Ltd., FNP090): | 270 parts |
| Anionic surfactant (TAYCA POWER BN2060 manufactured by Tayca Corporation, active ingredient amount: 60%): (as effective component, 3.0% with respect to releasing agent) | 13.5 parts |
| Ion exchanged water: | 21.6 parts |

The components are mixed, the releasing agent is dissolved with a pressure discharge type homogenizer (GAULIN HOMOGENIZER manufactured by Gaulin Co., Ltd.) at an inner liquid temperature of 120° C., and a dispersion treatment is performed at a dispersion pressure of 5 MPa for 120 minutes and subsequently at 40 MPa for 360 minutes, and the mixture is cooled, so as to obtain a releasing agent dispersion. The volume average particle diameter D50 of the particle in this releasing agent dispersion is 225 nm. Thereafter, ion exchange water is added such that the concentration of the solid content is adjusted to 20.0%.

Preparation of Toner Particle

| | |
|---|---|
| Ion exchange water: | 600 parts |
| Resin particle dispersion (1): | 250 parts |
| Pigment particle dispersion: | 331 parts |
| Releasing agent particle dispersion: | 82 parts |
| Anionic surfactant (TAYCA POWER BN2060 manufactured by Tayca Corporation, active ingredient amount: 20%): | 8 parts |

The material is placed in a round type stainless steel flask, 0.1 M nitric acid is added such that pH is adjusted to 4.0, and 13 parts of an aqueous solution in which a concentration of aluminum sulfate is 10% is added. Subsequently, the mixture is dispersed at 30° C. by using a homogenizer (ULTRA-TURRAX T50: manufactured by IKA-Werke GmbH & Co. KG), heated to 47° C. in a heating oil bath at a rotation speed of 500 rpm, and maintained for 60 minutes.

Thereafter, 220 parts of the resin particle dispersion (1) is gradually added and is maintained for one hour, 11 parts of an aqueous sodium hydroxide solution of 0.5 M and 10 parts of aqueous 15% sodium ethylenediaminetetraacetate solution are added such that pH is adjusted to 7.5, heating is performed to 95° C. while stirring is continued, and the mixture is maintained for five hours. Thereafter, the mixture is cooled to 20° C. at a rate of 20° C./min, filtered, sufficiently washed with ion exchanged water, and dried, so as to obtain a toner particle having a volume average particle diameter of 7.3 μm.

Manufacturing of Toner 100 parts of the toner particle, 0.3 parts of hydrophobic silica: RX50 manufactured by Nippon Aerosil Co., Ltd. as an external additive, and 1.0 part of hydrophobic silica: R972 manufactured by Nippon Aerosil Co., Ltd. are blended for 15 minutes at a circumferential speed of 20 m/s using a HENSCHEL MIXER, and a coarse particle is removed using a sieve with a 45 μm mesh, so as to obtain a toner.

Manufacturing of Developer 36 parts of the toner and 414 parts of the carrier are introduced into a 2 liter V blender, stirred for 20 minutes, and then sieved at a mesh of 212 μm so as to prepare a developer including each toner. A carrier obtained by the following method is used as the carrier.

Manufacturing of Carrier

| | |
|---|---|
| Ferrite particle (volume average particle diameter: 35 μm): | 100 parts |
| Toluene: | 14 parts |
| Methyl methacrylate-perfluorooctylethyl acrylate copolymer: | 1.6 parts |
| Carbon black (trade name: VXC-72, manufactured by Cabot Corporation, volume resistivity: 100 Ωcm or less): | 0.05 parts |
| Crosslinked melamine resin particle (average particle diameter: 0.3 μm, insoluble in toluene): | 0.5 parts |

First, carbon black is diluted with toluene in a methyl methacrylate-perfluorooctylethyl acrylate copolymer, and dispersion is performed with a sand mill. Subsequently, the components other than a ferrite particle are dispersed in this dispersion with a stirrer for 10 minutes so as to prepare a coating layer forming solution. Next, this coating layer forming solution and the ferrite particle are introduced into in a vacuum deaeration type kneader and stirred at a temperature of 60° C. for 30 minutes, and then the pressure is reduced, and the toluene is distilled, a resin coated layer is formed, so as to obtain a carrier.

Example 2

In Example 1, a white developer is obtained in the same manner as in Example 1 except for changing the amount of the aqueous sodium aluminate solution to 155 g in the manufacturing of the pigment particles.

Example 3

In Example 1, a white developer is obtained in the same manner as in Example 1 except for changing the retention time after the addition of the aqueous sodium silicate solution to four hours in the manufacturing of the pigment particles.

Example 4

In Example 1, a white developer is obtained in the same manner as in Example 1 except for changing the retention time after adding the aqueous sodium silicate solution to one hour, changing the amount of an aqueous sodium aluminate solution to 205 g, and changing the retention time at 60° C. to 75° C. to two hours after the pH is readjusted to 5.5 in the manufacturing of the pigment particle.

Example 5

In Example 1, a white developer is obtained in the same manner as in Example 1 except for changing the retention time at 60° C. to 75° C. to two hours after the pH is readjusted to 5.5 in the manufacturing of the pigment particles.

Example 6

In Example 1, a white developer is obtained in the same manner as in Example 1 except for changing the amount of fumaric acid to 52 parts by moles and adding 17 parts by moles of trimellitic acid in the preparation of the resin particle dispersion (1).

Example 7

In Example 1, a white developer is obtained in the same manner as in Example 1 except for changing the amount of fumaric acid to 50 parts by moles and adding 20 parts by moles of ethylene glycol in the preparation of the resin particle dispersion (1).

Example 8

In Example 1, a white developer is obtained in the same manner as in Example 1 except for changing the amount of fumaric acid to 50 parts by moles and adding 20 parts by moles of trimellitic acid in the preparation of the resin particle dispersion (1).

Example 9

In Example 1, a white developer is obtained in the same manner as in Example 1 except for changing the amount of fumaric acid to 45 parts by moles and adding 25 parts by moles of ethylene glycol in the preparation of the resin particle dispersion (1).

Example 10

In Example 1, a white developer is obtained in the same manner as in Example 1 except for changing the titanium dioxide particle to a titanium dioxide particle in which the proportion of the particle having a particle circularity of 0.90 or more is 63.7% with respect to the entire particle and an average particle diameter is 259 nm in the manufacturing of the pigment particle.

Example 11

In Example 1, a white developer was obtained in the same manner as in Example 1 except for changing the paraffin wax to ester wax (WEP5 manufactured by Nippon Seiro Co., Ltd.) in the preparation of the releasing agent dispersion.

Example 12

In Example 1, a white developer is obtained in the same manner as in Example 1 except for changing the titanium dioxide particle to a titanium dioxide particle in which the proportion of the particle having a particle circularity of 0.90 or more is 65.4% with respect to the entire particle and an average particle diameter is 382 nm and changing the amount of the aqueous sodium aluminate solution to 160 g, in the manufacturing of the pigment particle.

Example 13

In Example 1, a white developer is obtained in the same manner as in Example 1 except for changing the titanium dioxide particle to a titanium dioxide particle in which the proportion of the particle having a particle circularity of 0.90 or more is 65.9% with respect to the entire particle and an average particle diameter is 167 nm and changing the amount of the aqueous sodium aluminate solution to 185 g in the manufacturing of the pigment particle.

Example 14

In Example 1, a white developer is obtained in the same manner as in Example 1 except for changing the titanium dioxide particle to a titanium dioxide particle in which the proportion of the particle having a particle circularity of 0.90 or more is 65.4% with respect to the entire particle and an average particle diameter is 396 nm and changing the amount of the aqueous sodium aluminate solution to 210 g in the manufacturing of the pigment particle.

Example 15

In Example 1, a white developer is obtained in the same manner as in Example 1 except for changing the titanium dioxide particle to a titanium dioxide particle in which the proportion of the particle having a particle circularity of 0.90 or more is 65.3% with respect to the entire particle and an average particle diameter is 155 nm and changing the amount of the aqueous sodium aluminate solution to 145 g in the manufacturing of the pigment particle.

Example 16

Preparation of Resin Particle Dispersion (2)

| | |
|---|---|
| Styrene: | 410 parts |
| n-Butyl acrylate: | 175 parts |
| Acrylic acid: | 4 parts |
| Dodecanethiol: | 11 parts |
| Anionic surfactant (DOW FAX, manufactured by The Dow Chemical Company): | 15 parts |
| Ion exchange water: | 1,200 parts |

Among the above components, styrene, n-butyl acrylate, acrylic acid, and dodecanethiol are mixed to prepare a solution, and this solution is dispersed and emulsified in a flask including the anionic surfactant and ion exchanged water (Monomer emulsion 1). 2 parts of the anionic surfactant are dissolved in 400 parts of ion exchange water and introduced into a polymerization flask. This flask for polymerization is tightly sealed, a reflux pipe is provided, stirring is performed by substituting inside of the flask for polymerization, and the flask for polymerization is heated with a water bath to 75° C. A solution obtained by dissolving 10 parts of ammonium persulfate in 90 parts of ion exchange water is added to the flask for polymerization, and the monomer emulsion 1 is added dropwise over 60 minutes by using a tube pump. Thereafter, while the flask for polymerization is maintained at 80° C., the flask is stirred for 6 hours, the flask for polymerization is cooled to 25° C. with ice water, and the polymerization is ended. Accordingly, the resin dispersion having an acid value of 12.5 mgKOH/g is obtained. Ion exchanged water is added to the resin particle dispersion, and the solid content is adjusted to 30 mass %, so as to obtain a resin particle dispersion (2). In Example 1, a white developer is obtained in the same manner as in Example 1 except for changing the resin particle dispersion (1) to the resin particle dispersion (2).

Example 17

| | |
|---|---|
| Polyester resin: | 156.0 parts |
| Titanium oxide pigment: | 100.0 parts |
| Paraffin wax (Nippon Seiro Co., Ltd., FNP090): | 15 parts |
| Anionic surfactant (TAYCA POWER BN2060 manufactured by Tayca Corporation, active ingredient amount: 60%): (as effective component, 3.0% with respect to releasing agent) | 13.5 parts |

As the polyester resin and the titanium oxide pigment, those obtained by the same method as that of Example 1 are used. The material is heated to 90° C. and melted, and then melted and kneaded with an extruder at a set temperature of 150° C., a screw rotation speed of 280 rpm, and a feed speed of 220 kg/hour. The material cooled, coarsely pulverized, and finely pulverized with a jet mill, and the pulverized material is classified by wind power, so as to obtain a toner particle having a volume average particle diameter of 7.6 μm.

Example 18

In Example 1, a white developer is obtained in the same manner as in Example 1 except for changing the retention time after adding the aqueous sodium silicate solution to one hour and changing the amount of an aqueous sodium aluminate solution to 155 g in the manufacturing of the pigment particle.

Example 19

In Example 1, a white developer is obtained in the same manner as in Example 1 except for changing the retention time after adding the aqueous sodium silicate solution to 4.5 hour and changing the amount of an aqueous sodium aluminate solution to 155 g in the manufacturing of the pigment particle.

Example 20

In Example 1, a white developer is obtained in the same manner as in Example 1 except for changing the retention time after adding the aqueous sodium silicate solution to 30 minutes, changing the amount of an aqueous sodium aluminate solution to 205 g, and changing the retention time at 60° C. to 75° C. to 2.5 hours after the pH is readjusted to 5.5 in the manufacturing of the pigment particle.

Example 21

In Example 1, a white developer is obtained in the same manner as in Example 1 except for changing the retention time after adding the aqueous sodium silicate solution to two hours, changing the amount of an aqueous sodium aluminate solution to 205 g, and changing the retention time at 60° C. to 75° C. to two hours after the pH is readjusted to 5.5 in the manufacturing of the pigment particle.

Comparative Example 1

In Example 1, a white developer is obtained in the same manner as in Example 1 except for changing the retention time after adding the aqueous sodium silicate solution to 30 minutes and changing the amount of an aqueous sodium aluminate solution to 155 g.

Comparative Example 2

In Example 1, a white developer is obtained in the same manner as in Example 1 except for changing the retention time after adding the aqueous sodium silicate solution to 4.5 hour and changing the amount of an aqueous sodium aluminate solution to 135 g.

Comparative Example 3

In Example 1, a white developer is obtained in the same manner as in Example 1 except for changing the retention time after adding the aqueous sodium silicate solution to 30 minutes, changing the amount of an aqueous sodium aluminate solution to 205 g, and changing the retention time at 60° C. to 75° C. to three hours after the pH is readjusted to 5.5 in the manufacturing of the pigment particle.

Comparative Example 4

In Example 1, a white developer is obtained in the same manner as in Example 1 except for changing the retention time after adding the aqueous sodium silicate solution to two hours, changing the amount of an aqueous sodium aluminate solution to 205 g, and changing the retention time at 60° C. to 75° C. to 2.5 hours after the pH is readjusted to 5.5 in the manufacturing of the pigment particle.

Comparative Example 5

In Example 1, a white developer is obtained in the same manner as in Example 1 except for changing the amount of terephthalic acid to 20 parts by moles, changing the amount of fumaric acid to 40 parts by moles, adding 30 parts by moles of ethylene glycol, increasing the temperature to 230° C., and adding 40 parts by moles of ethylene glycol in the preparation of the resin particle dispersion (1).

Comparative Example 6

In Example 1, a white developer is obtained in the same manner as in Example 1 except for using JR600A (manufactured by Tayca Corporation) as the titanium dioxide pigment particle having aluminum oxide on the surface in the manufacturing of the pigment particle dispersion.

Comparative Example 7

In Example 1, a white developer is obtained in the same manner as in Example 1 except for using CR60 (manufactured by Ishihara Sangyo Kaisha, Ltd.) as the titanium dioxide pigment particle having aluminum oxide on the surface in the manufacturing of the pigment particle dispersion.

Evaluation

Evaluation of Image Defect

ApeosPortIV C3370 manufactured by Fuji Xerox Co., Ltd. is used as an evaluation sample preparation device. The developing machine is filled with the obtained developing agent, and 1000 sheets continuously are printed out at a low image density (density 5%) is obtained under an environment of 15° C. and 10 RH % by using A4 size black colored high quality thick paper manufactured by Hokuetsu Kishu Paper Co., Ltd. as a recording medium. Thereafter, the sample manufacturing device is moved to an environment of 28° C. and 95 RH %, and a rectangular solid image (density 100%) of 150×270 mm is continuously printed by 200 sheets. Whether there is an image defect on the 200 printed sheets is visually determined, and the number of sheets on which an image defect is generated in 200 sheets is compared.

The numbers of sheets are presented in Table 1.

Evaluation of Proportion of Toner Having Low Charge Amount

With respect to the toner particles in the developing machine after 200 sheets are printed in the evaluation of the image defect, the charge amount distribution of each toner particle is measured by the following method.

The charge amount distribution of each toner particle may be obtained by performing image analysis on a charge spectrograph that may be obtained by the charge spectrograph method (hereinafter, the "CSG method") disclosed in, for example, JP1982-79958A (JP-S57-79958A). In the frequency distribution of the charge amount obtained by image analysis, the number of toner particles having a charge amount of less than 20% on the low charging side with respect to the peak value is calculated and the proportion (number %) to the total number of toner particles is defined as a "proportion of a toner having a low charge amount".

In a case where the charge amount distribution is bipolarized, "present" is indicated in the column of "bipolarization". In a case where the charge amount distribution is bipolarized, "absent" is indicated in the column of "bipolarization". The present and absence of the bipolarization is determined by visually checking the chart.

The evaluation results are provided in Table 1.

As the proportion of a toner having a low charge amount is lower, it is considered that the generation of a toner having a low charge amount in a case of continuous printing is suppressed.

TABLE 1

| | Pigment particle | | | | | Binder resin | | | Evaluation result | | |
|---|---|---|---|---|---|---|---|---|---|---|---|
| | Surface aluminum proportion (atom %) | Surface titanium proportion (atom %) | Aluminum proportion in entire pigment particle (mass %) | Proportion of pigment particle having particle circularity of 0.90 or more | Volume average primary particle diameter (nm) | Type of resin | Type of releasing agent | Acid value (mgKOH/g) | Image defect (Number of sheets) | Binarization | Proportion of toner having low charge amount (number %) |
| Example 1 | 9.1 | 12.2 | 1.3 | 65.4 | 271 | Polyester | Paraffinic | 11.8 | 0 | Absence | 0.9 |
| Example 2 | 6.2 | 14.7 | 1.1 | 65.4 | 267 | Polyester | Paraffinic | 11.8 | 1 | Absence | 1.6 |
| Example 3 | 6.2 | 9.2 | 1.1 | 65.4 | 267 | Polyester | Paraffinic | 11.8 | 2 | Absence | 1.4 |
| Example 4 | 11.9 | 14.6 | 1.5 | 65.4 | 273 | Polyester | Paraffinic | 11.8 | 1 | Absence | 1.5 |
| Example 5 | 11.8 | 9.1 | 1.3 | 65.4 | 275 | Polyester | Paraffinic | 11.8 | 1 | Absence | 1.7 |
| Example 6 | 9.1 | 12.2 | 1.3 | 65.4 | 272 | Polyester | Paraffinic | 17.9 | 0 | Absence | 1.1 |
| Example 7 | 9.1 | 12.2 | 1.3 | 65.4 | 271 | Polyester | Paraffinic | 5.1 | 1 | Absence | 1.2 |
| Example 8 | 9.1 | 12.2 | 1.3 | 65.4 | 270 | Polyester | Paraffinic | 18.2 | 4 | Absence | 2.8 |
| Example 9 | 9.1 | 12.2 | 1.3 | 65.4 | 268 | Polyester | Paraffinic | 4.8 | 5 | Absence | 2.7 |
| Example 10 | 9.2 | 12.1 | 1.3 | 63.7 | 271 | Polyester | Paraffinic | 11.8 | 6 | Absence | 2.9 |
| Example 11 | 9.2 | 12.1 | 1.3 | 65.4 | 269 | Polyester | Ester-based | 11.8 | 5 | Absence | 2.8 |
| Example 12 | 9.0 | 12.3 | 1.2 | 65.7 | 390 | Polyester | Paraffinic | 11.8 | 2 | Absence | 1.3 |
| Example 13 | 9.1 | 12.4 | 1.3 | 65.9 | 175 | Polyester | Paraffinic | 11.8 | 1 | Absence | 1.0 |
| Example 14 | 9.3 | 12.1 | 1.5 | 65.4 | 403 | Polyester | Paraffinic | 11.8 | 5 | Absence | 3.0 |
| Example 15 | 9.1 | 12.0 | 1.1 | 65.3 | 165 | Polyester | Paraffinic | 11.8 | 4 | Absence | 2.9 |
| Example 16 | 9.2 | 12.1 | 1.3 | 65.4 | 270 | Styrene-acryl | Paraffinic | 12.5 | 4 | Absence | 3.0 |
| Example 17 | 9.2 | 12.1 | 1.3 | 65.4 | 271 | Polyester | Paraffinic | 11.8 | 6 | Absence | 3.4 |
| Example 18 | 6.1 | 15.2 | 1.1 | 65.4 | 271 | Polyester | Paraffinic | 11.8 | 8 | Presence | 3.8 |
| Example 19 | 6.1 | 8.8 | 1.1 | 65.4 | 273 | Polyester | Paraffinic | 11.8 | 7 | Presence | 4.0 |
| Example 20 | 11.8 | 15.3 | 1.5 | 65.4 | 274 | Polyester | Paraffinic | 11.8 | 8 | Presence | 3.9 |
| Example 21 | 11.8 | 8.9 | 1.5 | 65.4 | 268 | Polyester | Paraffinic | 11.8 | 8 | Presence | 3.7 |
| Comparative Example 1 | 5.8 | 14.7 | 1.1 | 65.4 | 276 | Polyester | Paraffinic | 11.8 | 15 | Presence | 5.4 |
| Comparative Example 2 | 5.7 | 9.2 | 1.0 | 65.4 | 273 | Polyester | Paraffinic | 11.8 | 17 | Presence | 6.0 |
| Comparative Example 3 | 12.2 | 14.9 | 1.5 | 65.4 | 271 | Polyester | Paraffinic | 11.8 | 16 | Presence | 5.5 |
| Comparative Example 4 | 12.3 | 9.2 | 1.5 | 65.4 | 273 | Polyester | Paraffinic | 11.8 | 17 | Presence | 5.8 |
| Comparative Example 5 | 9.1 | 12.2 | 1.3 | 65.4 | 270 | Polyester | Paraffinic | 0 | 18 | Presence | 6.1 |
| Comparative Example 6 | 12.6 | 8.6 | 1.6 | 51.2 | 271 | Polyester | Paraffinic | 11.8 | 20 | Presence | 7.1 |
| Comparative Example 7 | 5.8 | 12.7 | 1.0 | 52.1 | 213 | Polyester | Paraffinic | 11.8 | 21 | Presence | 7.3 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a toner particle that includes a pigment particle having a surface aluminum proportion by an X-ray photoelectron spectroscopy of 6.0 atom % or more and 12.0 atom % or less and a binder resin having a carboxy group.

2. The electrostatic charge image developing toner according to claim 1, wherein the surface aluminum proportion is 8.0 atom % or more and 10.0 atom % or less.

3. The electrostatic charge image developing toner according to claim 1, wherein the pigment particle includes titanium oxide, zinc oxide, or zirconium oxide.

4. The electrostatic charge image developing toner according to claim 3, wherein a surface titanium proportion of the pigment particle by an X-ray photoelectron spectroscopy is 9.0 atom % or more and 15.0 atom % or less.

5. The electrostatic charge image developing toner according to claim 3, wherein the pigment particle includes titanium oxide.

6. The electrostatic charge image developing toner according to claim 1, wherein a proportion of the pigment particle having a particle circularity of 0.90 or more in the pigment particle is 65 number % or more.

7. The electrostatic charge image developing toner according to claim 1, wherein an acid value of the binder resin is 5 mgKOH/g or more and 18 mgKOH/g or less.

8. The electrostatic charge image developing toner according to claim 1, further comprising:

a releasing agent that is paraffinic hydrocarbon.

9. The electrostatic charge image developing toner according to claim 8, wherein a content of the releasing agent is 0.1 mass % or more and 9.0 mass % or less with respect to a total mass of the toner particle.

10. The electrostatic charge image developing toner according to claim 1, wherein a number average primary particle diameter of the pigment particle is 170 nm or more and 400 nm or less.

11. An electrostatic charge image developer comprising:

the electrostatic charge image developing toner according to claim 1.

12. A toner cartridge comprising:

a container that accommodates the electrostatic charge image developing toner according to claim 1, wherein the toner cartridge is detachably attached to an image forming device.

* * * * *